US010674806B1

(12) United States Patent
Hammond et al.

(10) Patent No.: US 10,674,806 B1
(45) Date of Patent: Jun. 9, 2020

(54) HEATED HAIR-STRAIGHTENING GLOVE

(71) Applicants: Aaron Hammond, Smyrna, GA (US); Shedra Hammond, Smyrna, GA (US)

(72) Inventors: Aaron Hammond, Smyrna, GA (US); Shedra Hammond, Smyrna, GA (US)

( * ) Notice: Subject to any disclaimer, the term of this patent is extended or adjusted under 35 U.S.C. 154(b) by 433 days.

(21) Appl. No.: 15/478,349

(22) Filed: Apr. 4, 2017

(51) Int. Cl.

| | |
|---|---|
| ***A45D 7/02*** | (2006.01) |
| ***A46B 5/04*** | (2006.01) |
| ***A46B 15/00*** | (2006.01) |
| ***A46B 9/02*** | (2006.01) |
| ***A46B 11/00*** | (2006.01) |
| ***A46B 11/08*** | (2006.01) |
| ***A45D 2/00*** | (2006.01) |
| ***A45D 6/00*** | (2006.01) |
| ***A45D 19/16*** | (2006.01) |
| ***A45D 24/34*** | (2006.01) |

(52) U.S. Cl.
CPC ..... *A46B 5/04* (2013.01); *A45D 2/001* (2013.01); *A45D 6/00* (2013.01); *A45D 19/16* (2013.01); *A45D 24/34* (2013.01); *A46B 9/023* (2013.01); *A46B 11/0062* (2013.01); *A46B 11/08* (2013.01); *A46B 15/003* (2013.01); *A46B 2200/104* (2013.01)

(58) Field of Classification Search
CPC . A45D 2/001; A45D 2/00; A45D 6/00; A45D 19/00; A45D 19/16; A45D 24/34; A46B 5/04; A46B 9/023; A46B 11/0062; A46B 11/08
USPC ..... 2/159, 160; 401/7
See application file for complete search history.

(56) References Cited

U.S. PATENT DOCUMENTS

| | | | | |
|---|---|---|---|---|
| 3,298,368 | A * | 1/1967 | Charos | A41D 19/0055 604/291 |
| 3,869,594 | A * | 3/1975 | Shively | A41D 19/01535 219/211 |
| 4,766,914 | A * | 8/1988 | Briggs | A45D 20/00 132/212 |
| 4,903,864 | A * | 2/1990 | Sirhan | A63H 37/00 2/160 |
| 5,526,578 | A | 6/1996 | Iyer | |
| 5,720,048 | A | 2/1998 | Perez | |
| 5,944,031 | A | 8/1999 | Farley | |
| 6,109,214 | A * | 8/2000 | Rampersad | A46B 5/04 119/600 |
| 6,189,150 | B1 | 2/2001 | Jones-Roberson | |

(Continued)

FOREIGN PATENT DOCUMENTS

CN 203152852 8/2013

*Primary Examiner* — Rachel R Steitz
(74) *Attorney, Agent, or Firm* — Kyle A. Fletcher, Esq.

(57) ABSTRACT

The heated hair-straightening glove is a device that is adapted to be worn as a glove, and which is adapted to be used to style or straighten hair. The heated hair-straightening glove features a steaming function, a lotion-delivery capability, and a hair brush function. The glove itself includes a powering member that is responsible for providing the electrical needs of all functions attributed with the glove. The steam function includes a water reservoir positioned on a back side of the glove, which is in fluid connection with a heating member that produces steam. Said steam is distributed via a manifold to a plurality of conduits integrated into the construction of a front side of the glove. The front side of the glove also includes a plurality of brush nodes that work as a hair brush in use with hair.

14 Claims, 5 Drawing Sheets

(56) References Cited

U.S. PATENT DOCUMENTS

| | | | |
|---|---|---|---|
| D445,995 | S | 8/2001 | Stanley |
| 7,178,531 | B2 | 2/2007 | Carballada |
| 7,307,242 | B1 | 12/2007 | Chen |
| 2007/0068548 | A1 | 3/2007 | Wong |
| 2010/0269845 | A1 | 10/2010 | Tamme |

* cited by examiner

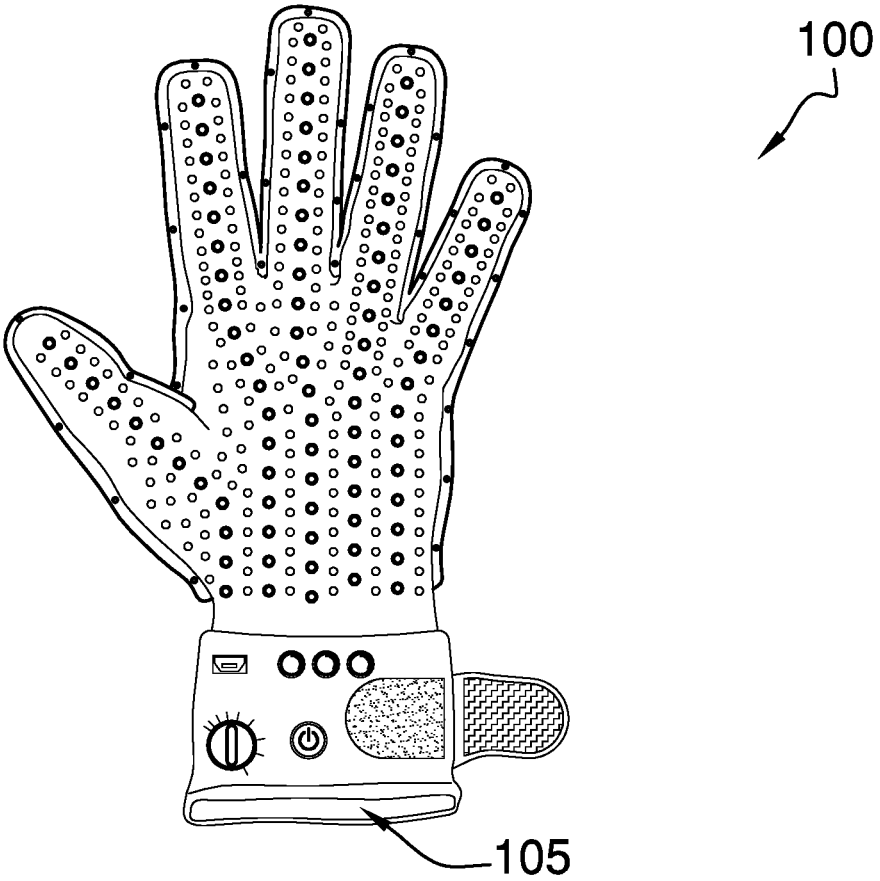
FIG. 5
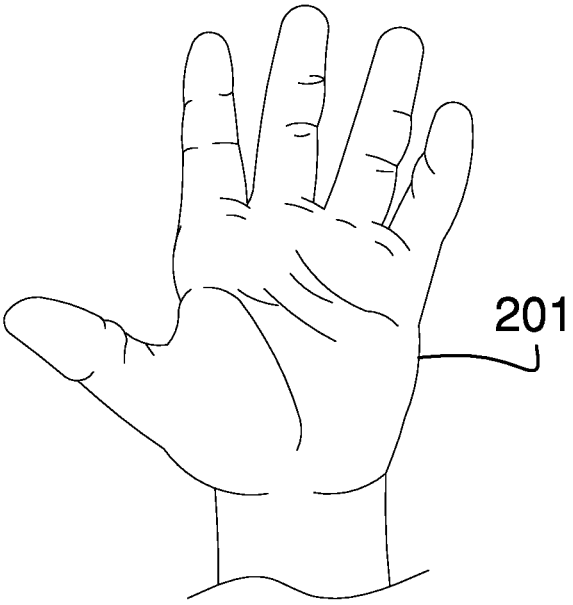

HEATED HAIR-STRAIGHTENING GLOVE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of hair-treating accessories, more specifically, a glove that is adapted to straighten hair.

SUMMARY OF INVENTION

The heated hair-straightening glove is a device that is adapted to be worn as a glove, and which is adapted to be used to style or straighten hair. The heated hair-straightening glove features a steaming function, a lotion-delivery capability, and a hair brush function. The glove itself includes a powering member that is responsible for providing the electrical needs of all functions attributed with the glove. The steam function includes a water reservoir positioned on a back side of the glove, which is in fluid connection with a heating member that produces steam. Said steam is distributed via a manifold to a plurality of conduits integrated into the construction of a front side of the glove. The front side of the glove also includes a plurality of brush nodes that work as a hair brush in use with hair. The lotion-delivery capability includes a lotion reservoir located on the back side of the glove, a lotion conduit connects to the lotion reservoir. The lotion conduit extends along a periphery of the glove. A plurality of lotion nozzles provided along the length of the lotion conduit is responsible for distributing lotion when in use. The glove features a layer of insulation to protect the hand of the end user from excessive heat when the device is in use.

It is an object of the invention to provide a glove that can be used to brush hair.

It is a further object of the invention for said glove to dispense steam in order to straighten hair.

It is a further object of the invention to provide a means of dispensing a lotion from said glove whilst treating hair with a brush and steam.

It is a further object of the invention to provide a glove that is highly portable, and easy to use in straightening hair.

It is a further object of the invention to provide a glove that includes a heating element adjacent a front surface of the glove so as to aid in maintaining steam as well as to warm up the brush nodes so as to collectively aid in straightening hair.

It is a further object of the invention to provide a layer of insulation that protects the hand of the end user from excessive heat associated with the heating element and the steam.

These together with additional objects, features and advantages of the heated hair-straightening glove will be readily apparent to those of ordinary skill in the art upon reading the following detailed description of the presently preferred, but nonetheless illustrative, embodiments when taken in conjunction with the accompanying drawings.

In this respect, before explaining the current embodiments of the heated hair-straightening glove in detail, it is to be understood that the heated hair-straightening glove is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the heated hair-straightening glove.

It is therefore important that the claims be regarded as including such equivalent construction insofar as they do not depart from the spirit and scope of the heated hair-phraseology straightening glove. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

FIG. 5 is a side view of an embodiment of the disclosure.

DETAILED DESCRIPTION OF THE EMBODIMENT

Figure 1:
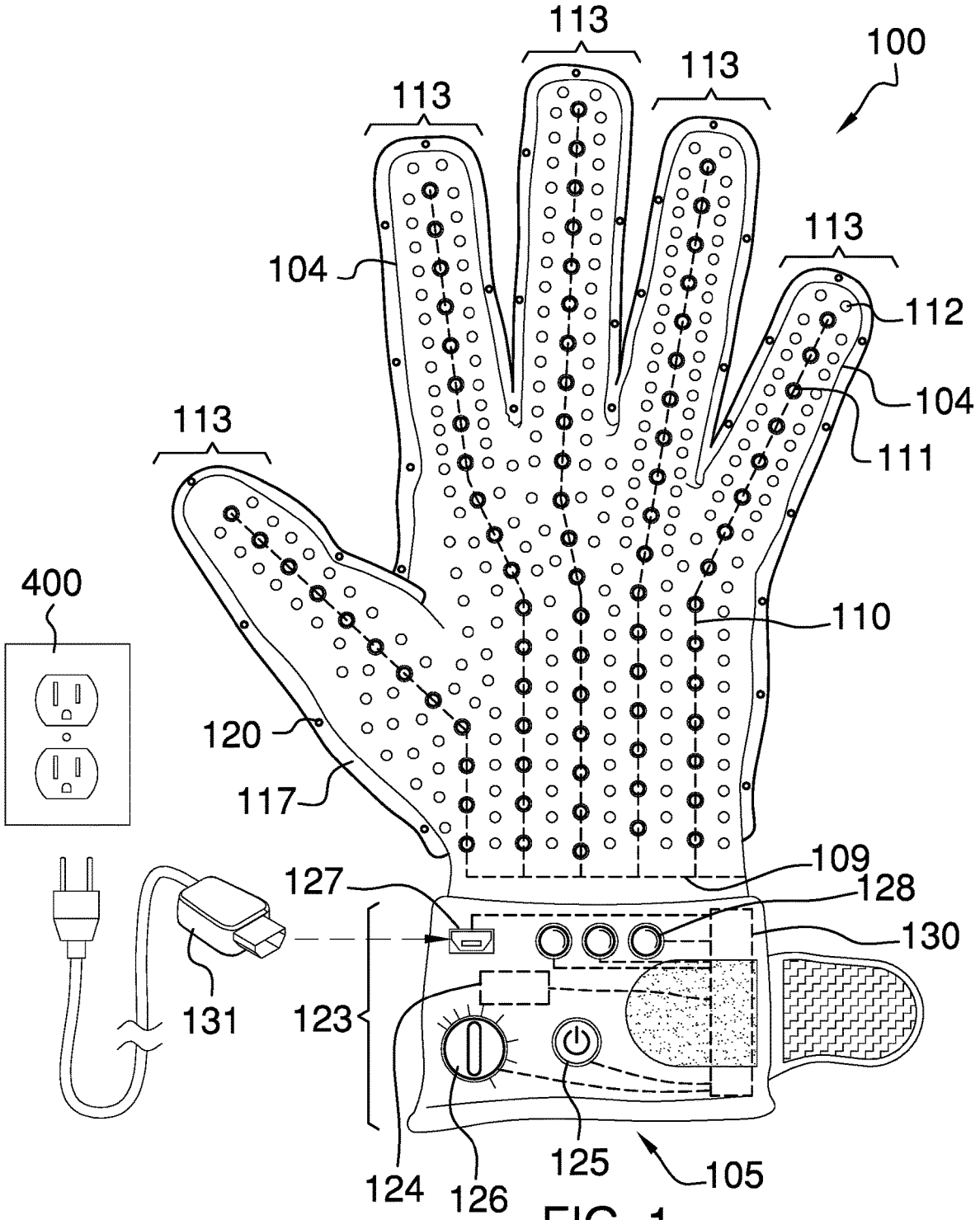
FIG. 1 is a front view of an embodiment of the disclosure.
Figure 2:
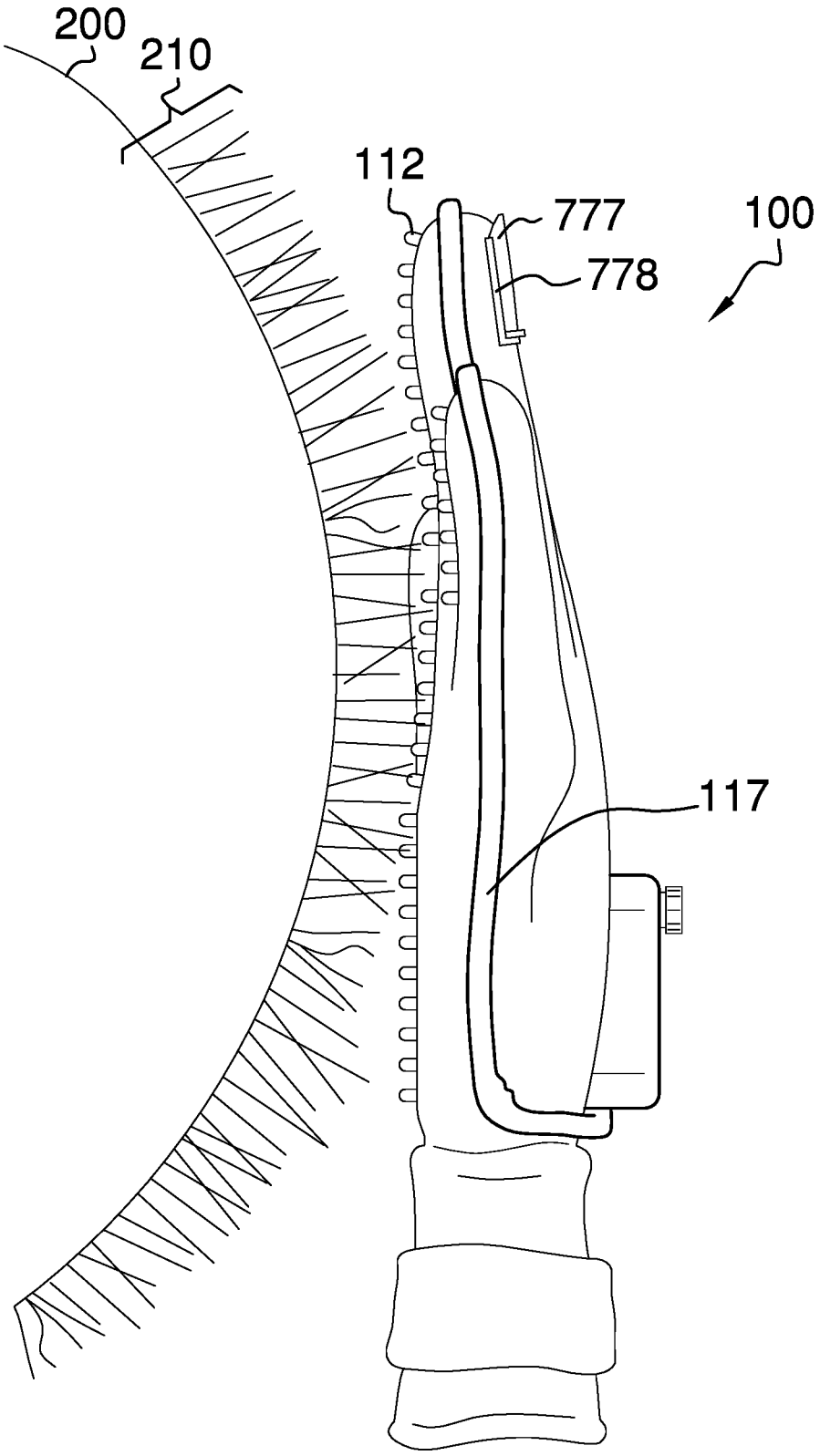
FIG. 2 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 4.

The heated hair-straightening glove 100 (hereinafter invention) comprises a glove 101 that is further defined with a front side 102, a back side 103, a periphery edge 104, and an opening 105. The front side 102 of the glove 101 is opposite of the back side 103. The periphery edge 104 defines the boundary of both the front side 102 as well as the back side 103. The opening 105 of the glove 101 is adapted to enable insertion or removal of a hand 201 of an end user 200 with respect to the invention 100.

The invention 100 is able to generate steam 300, which is dispensed from the front side 102 of the glove 101. The invention 100 includes a water reservoir 106 that is provided on the back side 103 of the glove 101. The water reservoir 106 includes a refill port 107 that enables the water reservoir 106 to be refilled as needed. The water reservoir 106 is connected to a heating member 108. The heating member 108 receives water from the water reservoir 106, and turns said water into steam 300. The steam 300 is then transferred to a manifold 109 integrated within the glove 101, but on the front side 102 of the glove 101. The manifold 109 in turn distributes the steam 300 to a plurality of steam conduits 110 that are also integrated into the construction of the glove 101. The steam conduits 110 are adapted to align with fingers 202 of the hand 201. The steam conduits 110 each include a plurality of steam ports 111 that adaptively dispense steam 300 from the front side 102 of the glove 101.

Figure 4:
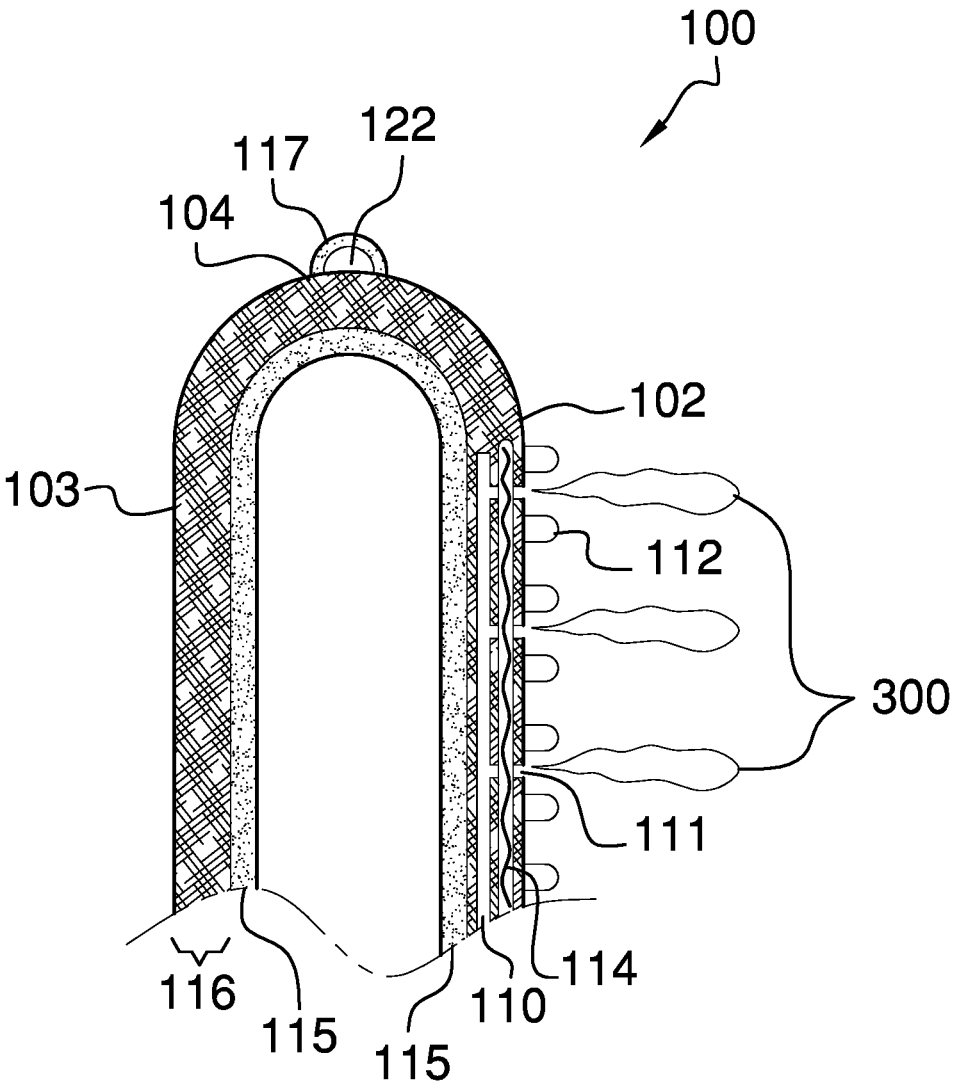
FIG. 4 is a cross-sectional view of an embodiment of the disclosure across line 4-4 in FIG. 3.

The front side 102 of the glove 101 also includes a plurality of brush nodes 112. The plurality of brush nodes 112 are provided on each of the several finger portions 113 of the glove 101. Moreover, the plurality of brush nodes 112 extend outwardly from the front side 102 of the glove 101. The plurality of brush nodes 112 are adapted to brush hair 250 of the end user 200. Referring to FIG. 4, the invention 100 also includes a heating element 114. The heating element 114 traverses across the several finger portions 113 of the glove 101. Moreover, the heating element 114 traverses across the front side 102 of the glove 101. The heating element 114 generates heat that is applied to the plurality of brush nodes 112 as well as to the steam conduits 110. The purpose of the heating element 114 is to sustain the steam 300 generated via the heating member 108, and also to warm or heat the plurality of brush nodes 112 when in use with the hair 210 of the end user 200.

Referring to FIG. 4, the glove 101 is constructed of an inner insulation layer 115. The inner insulation layer 115 interfaces with an outer layer 116. The outer layer 116 of the glove 101 is visible. The outer layer 116 includes the steam conduits 110, the plurality of brush nodes 112, and the heating element 114. The heating element 114 is impregnated into the construction of the outer layer 116. The inner insulation layer 115 is provided with the invention 100 to insulate the hand 201 of the end user 200 from heat generated via the heating member 108 as well as the heating element 114.

Provided along the periphery edge 104 of the glove 101 is a lotion conduit 117. The lotion conduit 117 is attached to a lotion reservoir 118. The lotion reservoir 118 is provided on the back side 103 of the glove 101. Moreover, the lotion reservoir 118 is adjacent to the water reservoir 106. A lotion pump 119 is provided in-line between the lotion reservoir 118 and the lotion conduit 117. The lotion pump 119 is responsible for pumping lotion from the lotion reservoir 118 through the lotion conduit 117. The lotion conduit 117 includes a plurality of lotion nozzles 120 that dispense lotion therefrom. The lotion reservoir 118 is also further defined with a lotion refill portion 121 that enables the lotion reservoir 118 to be refilled with a lotion 122. The lotion 122 is adapted to be dispensed onto the hair 210 of the end user 200.

The glove 101 is further defined with a wrist portion 123. The wrist portion 123 includes the opening 105 of the glove 101. Moreover, the wrist portion 123 houses some of the componentry required to operate the lotion pump 119, the heating member 108, the heating element 114. Moreover, the wrist portion 123 includes a powering member 124, which is ideally at least one battery. A command module 130 is wired to the powering member 124, an on/off button 125, a control knob 126, a recharge port 127, a plurality of light members 128, the lotion pump 119, the heating member 108, and the heating element 114.

The command module 130 is responsible for operation of the lotion pump 119, the heating member 108, and the heating element 114. The powering member 124 is recharged via the recharge port 127 whereby a recharging cord 131 is connected in order to supply electricity from a standard wall outlet 400. The plurality of light members 128 provide user feedback as to the operation of the lotion pump 119, the heating member 108, and the heating element 114. The on/off button 125 simply turns on or off the invention 100. The control knob 126 provides for adjustment of the output of the heating element 114, the heating member 108, and/or the lotion pump 119.

Figure 3:
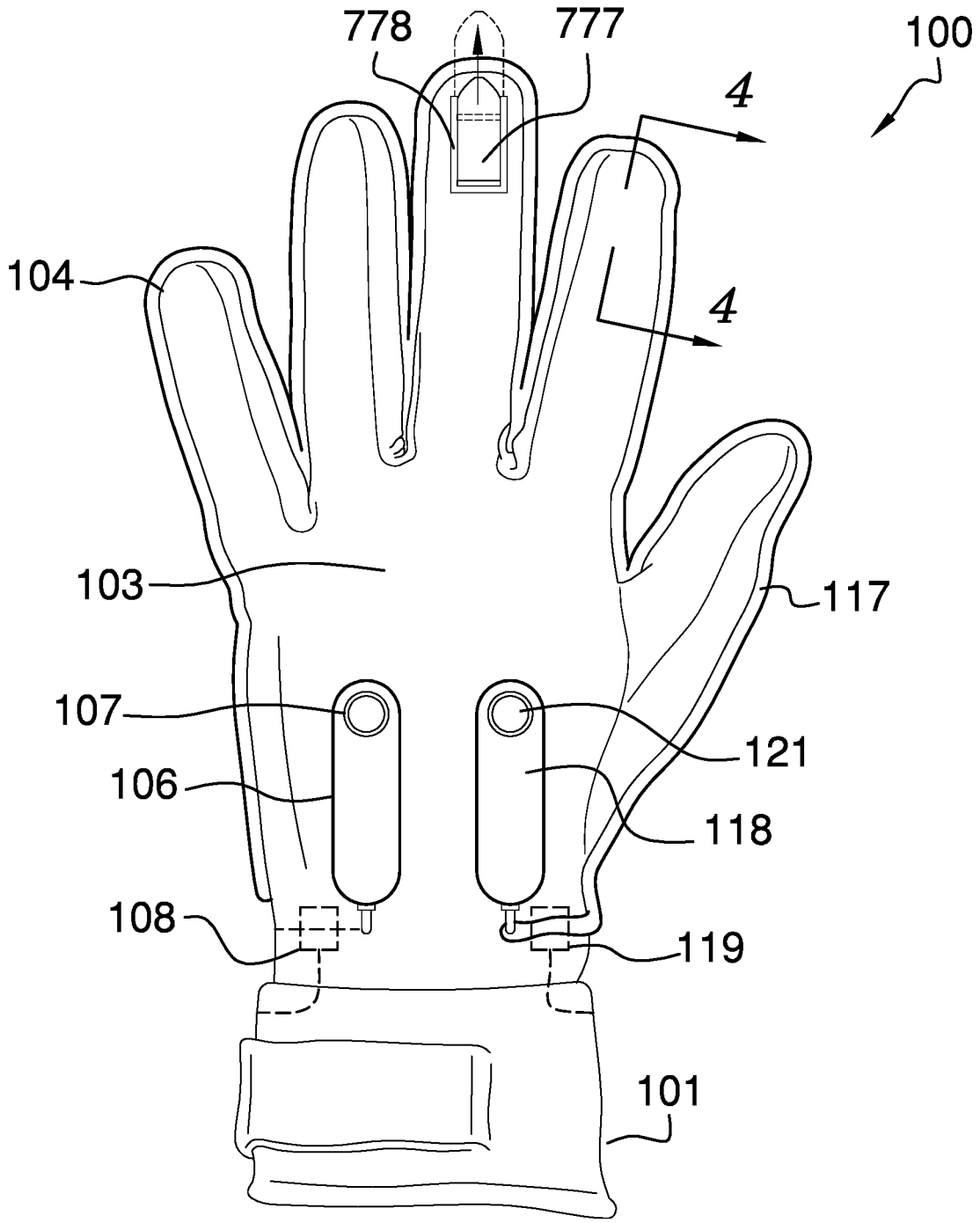
FIG. 3 is a rear view of an embodiment of the disclosure.

Referring to FIG. 3, the invention 100 may include a hair pick 777. The hair pick 777 is a device that extends from one of the several finger portions 113 of the glove 101. More specifically, the hair pick 777 is provided on the back side 103 of the glove 101. Also, the hair pick 777 is adjacent to the periphery edge 104. The hair pick 777 is adapted to be used in parting the hair 210 of the end user 200 as needed.

The hair pick 777 is able to extend and retract from a pick bracket 778 that is permanently affixed to the back side 103 of the glove 103. Referring to FIG. 3, the hair pick 777 extends and retracts as is needed via the pick bracket 778.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A hair-treating accessory comprising:

a glove adapted to be worn via a hand of an end user;

wherein said glove is adapted to be used as a brush with hair of said end user;

wherein the glove is further defined with a front side, a back side, a periphery edge, and an opening;

wherein the front side of the glove is opposite of the back side;

wherein the periphery edge defines the boundary of both the front side as well as the back side;

wherein the opening of the glove is adapted to enable insertion or removal of a hand of an end user with respect to the glove;

wherein a water reservoir is provided on the back side of the glove;

wherein the water reservoir includes a refill port that enables the water reservoir to be refilled as needed;

wherein the water reservoir is connected to a heating member;

wherein the heating member receives water from the water reservoir, and turns said water into steam;

wherein the steam is then transferred to a manifold integrated within the glove, but on the front side of the glove;

wherein said steam being adapted to be used to straighten said hair of said end user.

2. The hair-treating accessory according to claim 1 wherein the manifold in turn distributes the steam to a plurality of steam conduits that are also integrated into the construction of the glove; wherein the steam conduits are adapted to align with fingers of the hand of said end user.

3. The hair-treating accessory according to claim 2 wherein the steam conduits each include a plurality of steam ports that adaptively dispense steam from the front side of the glove.

4. The hair-treating accessory according to claim 3 wherein the front side of the glove also includes a plurality of brush nodes; wherein the plurality of brush nodes are provided on each of the several finger portions of the glove.

5. The hair-treating accessory according to claim 4 wherein the plurality of brush nodes extend outwardly from the front side of the glove; wherein the plurality of brush nodes are adapted to brush hair of the end user.

6. The hair-treating accessory according to claim 5 wherein the heating element traverses across the several finger portions of the glove; wherein the heating element traverses across the front side of the glove; wherein the heating element generates heat that is applied to the plurality of brush nodes as well as to the steam conduits; wherein the heating element sustains the steam generated via the heating member, and also heats the plurality of brush nodes.

7. The hair-treating accessory according to claim 6 wherein the glove is constructed of an inner insulation layer; wherein the inner insulation layer interfaces with an outer layer; wherein the outer layer of the glove is visible.

8. The hair-treating accessory according to claim 7 wherein the outer layer includes the steam conduits, the plurality of brush nodes, and the heating element; wherein the heating element is impregnated into the construction of the outer layer; wherein the inner insulation layer is provided in order to adaptively insulate the hand of the end user from heat generated via the heating member as well as the heating element.

9. The hair-treating accessory according to claim 8 wherein provided along the periphery edge of the glove is a lotion conduit; wherein the lotion conduit is attached to a lotion reservoir; wherein the lotion reservoir is provided on the back side of the glove.

10. The hair-treating accessory according to claim 9 wherein the lotion reservoir is adjacent to the water reservoir; wherein a lotion pump is provided in-line between the lotion reservoir and the lotion conduit; wherein the lotion pump is responsible for pumping lotion from the lotion reservoir through the lotion conduit.

11. The hair-treating accessory according to claim 10 wherein the lotion conduit includes a plurality of lotion nozzles that dispense lotion therefrom; wherein the lotion reservoir is also further defined with a lotion refill portion that enables the lotion reservoir to be refilled with a lotion; wherein the lotion is adapted to be dispensed onto the hair of the end user.

12. The hair-treating accessory according to claim 11 wherein the glove is further defined with a wrist portion; wherein the wrist portion includes the opening of the glove; wherein the wrist portion houses some of the componentry required to operate the lotion pump, the heating member, the heating element.

13. The hair-treating accessory according to claim 12 wherein the wrist portion includes a powering member; wherein a command module is wired to the powering member, an on/off button, a control knob, a recharge port, a plurality of light members, the lotion pump, the heating member, and the heating element; wherein the command module is responsible for operation of the lotion pump, the heating member, and the heating element; wherein the powering member is recharged via the recharge port whereby a recharging cord is connected in order to supply electricity from a standard wall outlet; wherein the plurality of light members provide user feedback as to the operation of the lotion pump, the heating member, and the heating element; wherein the on/off button simply turns on or off the hair-treating accessory; wherein the control knob provides for adjustment of the output of the heating element, the heating member, and/or the lotion pump.

14. The hair-treating accessory according to claim 13 wherein a hair pick is included, and extends from one of the several finger portions of the glove; wherein the hair pick is provided on the back side of the glove; wherein the hair pick is adjacent to the periphery edge of the glove; wherein the hair pick is adapted to be used in parting the hair of the end user as needed; wherein the hair pick is able to extend and retract from a pick bracket that is permanently affixed to the back side of the glove; wherein the hair pick extends and retracts as is needed via the pick bracket.

* * * * *